US006300044B1

(12) United States Patent
Uytterhoeven et al.

(10) Patent No.: US 6,300,044 B1
(45) **Date of Patent: *Oct. 9, 2001**

(54) PRODUCTION METHOD FOR A PHOTOTHERMOGRAPHIC MATERIAL AND A RECORDING PROCESS

(75) Inventors: Herman Uytterhoeven, Bonheiden; Yvan Gilliams, Hever; Johan Loccufier, Zwijnaarde; Sabine Emmers, Duffel; Ronny De Clercq, Aalter, all of (BE)

(73) Assignee: Agfa-Gevaert (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/202,257

(22) PCT Filed: Jun. 13, 1996

(86) PCT No.: PCT/EP96/02579

§ 371 Date: Jun. 18, 1999

§ 102(e) Date: Jun. 18, 1999

(87) PCT Pub. No.: WO97/48014

PCT Pub. Date: Dec. 18, 1997

(51) Int. Cl.[7] ..... G03C 1/498

(52) U.S. Cl. ..... 430/350; 430/607; 430/609; 430/619; 430/620

(58) Field of Search ..... 430/619, 620, 430/607, 609

(56) References Cited

U.S. PATENT DOCUMENTS 3,957,517 * 5/1976 Ikenoue et al. .
4,173,482 * 11/1979 Akashi et al. ..... 430/619
5,028,523 * 1/1991 Skoug ..... 430/617

* cited by examiner

*Primary Examiner*—Thorl Chea
(74) *Attorney, Agent, or Firm*—Leydig, Voit & Mayer, Ltd

(57) ABSTRACT

A production method for a photothermographic recording material comprising the steps of: (i) providing a support; (ii) coating the support with a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterized in that the photosensitive silver halide is formed by reacting an aqueous emulsion of particles of the substantially light-insensitive organic silver salt with at least one onium salt with halide or polyhalide anion(s) and that the photo-addressable thermally developable element is coated from an aqueous dispersion medium; and a recording process therefor.

10 Claims, No Drawings

PRODUCTION METHOD FOR A PHOTOTHERMOGRAPHIC MATERIAL AND A RECORDING PROCESS

FIELD OF THE INVENTION

The present invention relates to a production method for a photothermographic material and a recording process therefor.

BACKGROUND OF THE INVENTION

Thermal imaging or thermography is a recording process wherein images are generated by the use of imagewise modulated thermal energy.

In thermography three approaches are known:

1. Direct thermal formation of a visible image pattern by imagewise heating of a recording material containing matter that by chemical or physical process changes colour or optical density.

3. Imagewise transfer of an ingredient necessary for the chemical or physical process bringing about changes in colour or optical density to a receptor element containing other of the ingredients necessary for the chemical or physical process followed by uniform heating to bring about the changes in colour or optical density.

3. Thermal dye transfer printing wherein a visible image pattern is formed by transfer of a coloured species from an imagewise heated donor element onto a receptor element.

Thermographic materials of type 1 can be rendered photothermographic by incorporating a photosensitive agent which after exposure to UV, visible or IR light is capable of catalyzing or participating in a thermoplastic process bringing about changes in colour or optical density.

U.S. Pat. No. 3,457,075 discloses a sheet material useful in imaging by a process involving exposure to a light-image followed by uniform heating and including a stratum containing (a) photosensitive silver halide catalyst-forming means and (b) heat-sensitive reactant image-forming means including (1) a water-insoluble silver salt of a long chain fatty acid as an oxidizing agent, and (2) a reducing agent for silver ion, the oxidation-reduction reaction of which to produce a visible change is accelerated by the catalyst; the stratum being further characterized in that a sufficient quantity, of at least about one-fourth mol percent based on the fatty acid silver salt, of the photosensitive means is in cataytic proximity with a sufficient proportion of the heat-sensitive means to provide a gamma infinity value of at least about 0.5 when the stratum is exposed image-wise to the light-image and the image is then developed by uniform heating and wherein the manufacture method for the sheet material comprises mixing with the fatty acid silver salt a source of halide ions under conditions permitting reaction therebetween with formation of the silver halide catalyst-forming means. As sources of halide ions for the conversion of organic silver salts to silver halides GB 1,547,326 lists: inorganic halides, halogen-containing metal complexes, onium halides (for example quaternary ammonium halides, quaternary phosphonium halides and ternary sulfonium halides), halogenated hydrocarbons, N-halo compounds and other halogen-containing compounds.

GB 1 342 525 discloses a photosensitive heat-processable material comprising a support and contained in a layer or layers thereof: (a) an oxidation/reduction image-forming system comprising: (b) a light-insensitive reducible metal compound and (c) an organic reducing agent therefor, (d) a photosensitive silver compound capable, on exposure to actinic radiation, of forming centres which catalyze the thermally induced oxidation/reduction reaction of (b) with (c) to form a visible image, and (e) a substantially colourless photographic speed-increasing onium halide.

The standard teaching over such photothermographic materials based on a substantially light-insensitive organic silver salt, photosensitive silver halide in intimate catalytic association with the organic silver salt and a reducing agent for the organic silver salt is that the organic silver salt is formed, optionally in the presence of ex situ formed silver halide, in an aqueous medium and is precipitated and dried before dispersion in an organic solvent medium from which the dispersion is coated, the silver halide either being prepared ex situ, and either added to a dispersion of the organic silver salt as described in U.S. Pat. No. 3,080,254 or being present during the formation of the organic silver salt as disclosed in U.S. Pat. No. 3,839,049, or being prepared in situ from the organic silver salt by reaction with a halide ion source as disclosed in U.S. Pat. No. 3,457,075. In the latter case reaction of organic silver salt with a halide ion source, which can be inorganic or organic, occurs after the dispersion of the organic silver salt in a solvent medium and hence the reaction takes place in a non-aqueous medium.

This production method is very inefficient as the organic silver salt after formation in water has to be separated and dried before dispersion in a solvent medium, is environmentally unsound as evaporation of solvent takes place during the coating process and it involves lengthy utilization of plant during the preparation of the organic silver salt dispersion and coating requires costly plant due to the need for solvent explosion prevention measures and solvent recovery to prevent solvent emission to the environment.

Furthermore, it is desirable spectrally to sensitize photosensitive silver halide in aqueous media as this permits the use of a broader range of spectrally sensitizing dyes.

Despite forty years of continuous research in this area, a production method for photothermographic materials based on a substantially light-insensitive organic silver salt, photosensitive silver halide in catalytic association with the organic silver salt and a reducing agent for the organic silver salt which disperses with these disadvantages of the current teaching, has to our knowledge not yet been developed.

WO 94/16361 discloses a multilayer heat-sensitive material for direct thermal recording for which no intermediate drying of organic noble metal salts is necessary and which is coatable from aqueous dispersions. This material comprises: a colour-forming amount of finely divided, solid colourless noble metal or iron salt of an organic acid distributed in a carrier composition; a color-developing amount of a cyclic or aromatic organic reducing agent, which at thermal copy and printing temperatures is capable of a colour-forming reaction with the noble metal or iron salt; and an image toning agent; characterized in that (a) the carrier composition comprises a substantially water-soluble polymeric carrier and a dispersing agent for the noble metal or iron salt and (b) the material comprises a protective overcoating layer for the colour-forming layer. However, this material suffers from poor stability both before and after image formation.

OBJECTS OF THE INVENTION

It is therefore a first object of the invention to provide a method of producing a photo-addressable thermally developable element for a photothermographic material with excellent image-forming properties.

It is therefore a second object of the invention to provide a photothermographic material with excellent image-forming properties.

It is therefore another object of the invention to provide a method of producing a photo-addressable thermally developable element based on a substantially light-insensitive organic silver salt, photosensitive silver halide in catalytic association with the organic silver salt and a reducing agent for the organic silver salt, which enables a broader range of spectral sensitizers to be used.

It is therefore a further object of the invention to provide a method of producing a photo-addressable thermally developable element based on a substantially light-insensitive organic silver salt, photosensitive silver halide in intimate catalytic association with the organic silver salt and a reducing agent for the organic silver salt, which is produceable without necessitating intermediate drying of the organic silver salt.

It is therefore a still further object of the invention to provide a method of producing a photo-addressable thermally developable element based on a substantially light-insensitive organic silver salt, photosensitive silver halide in catalytic association with the organic silver salt and a reducing agent for the organic silver salt, which is coatable from an aqueous medium.

It is therefore a yet still further object of the invention to provide a photothermographic imaging process utilizing a photothermographic material incorporating a photo-addressable thermally developable element based on a substantially light-insensitive organic silver salt, photosensitive silver halide in intimate catalytic association with the organic silver salt and a reducing agent for the organic silver salt, which is produceable without intermediate separation, drying and redispersion of the organic silver salt and is coatable from an aqueous medium.

Further objects and advantages of the invention will become apparent from the description hereinafter.

SUMMARY OF THE INVENTION

The above mentioned objects are realised by the specific features according to claim 1. Preferred embodiments of the invention are disclosed in the dependent claims.

According to the present invention a production method for a photothermographic recording material is provided comprising the steps of: (i) providing a support; (ii) coating the support with a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterized in that the photosensitive silver halide is formed by reacting an aqueous emulsion of particles of the substantially light-insensitive organic silver salt with at least one onium salt with halide or polyhalide anion(s) and that the photo-addressable thermally developable element is coated from an aqueous dispersion medium.

According to another embodiment of the present invention a recording process is provided comprising the steps of: (i) providing a photothermographic recording material comprising a photo-addressable thermally developable element, coated from an aqueous dispersion medium, comprising a substantially light-insensitive organic silver salt, photosensitive silver halide in intimate catalytic association with the substantially light-insensitive organic silver salt, a reducing agent in thermal working relationship with the substantially light-insensitive organic silver salt and a binder; (ii) bringing the recording material into the proximity of a source of actinic radiation to which it is sensitive; (iii) image-wise exposing the recording material to the actinic radiation; (iv) bringing the image-wise exposed recording material into proximity with a heat source; (v) thermally developing the image-wise exposed recording material; and (iv) removing the thermally developed image-wise exposed recording material from the heat source; characterized in that the photosensitive silver halide is produced by reacting an aqueous emulsion of particles of the substantially light-insensitive organic silver salt with at least one onium salt with halide or polyhalide anion(s) and at least one layer of the photo-addressable thermally developable element is produced by coating from an aqueous dispersion medium.

According to a further embodiment of the present invention a photothermographic recording material is provided comprising a photo-addressable thermally developable element comprising a substantially light-insensitive organic silver salt, a reducing agent in thermal working relationship with the substantially light-insensitive organic silver salt and a binder, characterized in that the photo-addressable thermally developable element further comprises at least one onium salt with halide or polyhalide anion(s) and that the binder is water soluble or water-dispersible.

DETAILED DESCRIPTION OF THE INVENTION

Aqueous

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc; glycols e.g. ethylene glycol; glycerine; N-methyl pyrrolidone; methoxypropanol; and ketones e.g. 2-propanone and 2-butanone etc.

Onium Halides and Polyhalides

According to the present invention, a production method is provided, wherein photosensitive silver halide is formed by reacting an aqueous dispersion of particles of the substantially light-insensitive organic silver salt with at least one onium salt with halide or polyhalide anions. By onium salts is meant, according to the definition given in "McGraw-Hill Dictionary of Scientific and Technical Terms, Fourth Edition, edited by S P Parker, McGraw-Hill Book Company, New York (1989)": "chemical suffix indicating a complex cation". The halide or polyhalide onium salts, according to the present invention, may be added as solids or solutions or may be formed in the aqueous dispersion of particles of the substantially light-insensitive silver salt by metathesis between a salt with halide or polyhalide anions and onium salts with anions other than halide or polyhalide.

Preferred oniums according to the present invention are organo-phosphonium, organo-sulphonium and organo-nitrogen onium cations, with heterocyclic nitrogen onium (e.g. pyridinium), quaternary phosphonium and ternary sulphonium cations being preferred. Preferred halide anions, according to the present invention, are chloride, bromide and iodide. Preferred polyhalide anions, according to the present invention, consist of chlorine, bromine and iodine atoms.

Onium cations according to the present invention, may be polymeric or non-polymeric. Suitable polymeric onium halides and polyhalides for partial conversion of particles of substantially light-insensitive organic silver salt into photosensitive silver halides according to the present invention are:

POLY01=a polyurethane resin 50% quaternized with ethyl bromide;

POLY02=a copolymer of 20.1 mol % of a mixture of tributyl(3-vinylbenzyl)phosphonium chloride and tributyl (4-vinylbenzyl)phosphonium chloride, 45.5 mol % of N-vinylimidazole and 34.4 mol % of acrylontrile;

POLY03=poly(2-vinylpyridine) quaternized with ethyl bromide;

POLY04=poly(2-vinylpyridine) quaternized with ethyl iodide;

POLY05=poly(4-vinylpyridine) hydrochloride

POLY06=poly(4-vinylpyridine) hydrobromide perbromide

POLY07=a copolymer of 83.5% by weight of acrylamide, 15% by weight of 4-vinylpyridine and 1.5% by weight of N-vinylimidazole quaternized with ethyl bromide;

POLY08=a copolymer of 8% by weight of styrene, 17% by weight of 4-vinylpyridine and 75% by weight of N-ethyl-4-vinylpyridinium bromide with 28% by weight of bromine;

POLY09=a copolymer of 46% by weight of styrene, 19% by weight of 4-vinylpyridine and 35% by weight of N-ethyl-4-vinylpyridinium bromide with 13% by weight of bromide;

POLY10=a copolymer of 62% by weight of styrene, 21% by weight of 4-vinylpyridine and 17% by weight of N-ethyl-4-vinylpyridinium bromide with 6.34% by weight of bromine;

POLY11=a copolymer of 77% by weight of styrene, 17% by weight of 4-vinylpyridine and 6% by weight of N-ethyl-4-vinylpyridinium bromide with 2.24% by weight of bromine.

Preferred non-polymeric onium slats for partial conversion of particles of substantially light-insensitive organic silver salt into photo-sensitive silver halides according to the present invention are:

the nitrogen-onium polyhalides (NC):

NC01=pyridinium hydrobromide perbromide

NC02=pyridinium hydrobromide

NC03=N-dodecyl-pyridinium iodide

NC04=N-hexadecyl-pyridinium bromide

NC05=α,ω-bis-(N-pyridinium)decane dibromide

NC06=2-(2-[1-(3-nitrophenyl)ethenyl]-N-(2-phenylethyl) pyridinium bromide

NC07=tetrabutylammonium bromide

NC08=tetrabutylammonium iodide

NC09=tetramethylammonium bromide the quaternary phosphonium polyhalides (PC):

PC01=3-(triphenyl-phosphonium)propionic acid bromide perbromide

PC02=3-(triphenyl-phosphonium)propionic acid bromide

PC03=3-(triphenyl-phosphonium)propionic acid iodide

PC04=3-(triphenyl-phosphonium)propionic acid iodide perchloride

PC05=3-(triphenyl-phosphonium)propionic acid iodide perbromide

PC06=2-(triphenyl-phosphonium)ethanol bromide

PC07=2-(triphenyl-phosphonium)ethanol chloride

PC08=methyl-triphenyl-phosphonium bromide

PC09=methyl-triphenyl-phosphonium iodide

PC10=tetraphenyl-phosphonium iodide perchloride and the ternary sulfonium polyhalide:

SC01=trimethylsulfonium iodide

The onium salts, according to the present invention, are present in quantities of between0.1 and 35 mol % with respect to the quantity of substantially light-insensitive organic silver salt of organic, with quantities between 0.5 and 20 mol % being preferred and with quantities between 1 and 12 mol % being particularly preferred.

Substantially Light-Insensitive Organic Silver Salts

Preferred substantially light-insensitive organic silver salts according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)-sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Particles of the silver salts of organic carboxylic acids are prepared by the reaction of a soluble silver salt with the organic carboxylic acid or a salt thereof.

A suspension of particles containing a substantially light-insensitive organic silver salt may be obtained by using a process, comprising simultaneous metered addition of a solution or suspension of an organic compound with at least one ionizable hydrogen atom or its salt; and a solution of a silver salt to a liquid, as described in the unpublished European patent application number 95201968.5.

Organic Reducing Agent

Suitable organic reducing agents for the reduction of said substantially light-insensitive organic heavy metal salts are organic compounds containing at least one active hydrogen atom linked to O, N or C. Suitable organic reducing agents for the reduction of the substantially light-insensitive organic silver salt, an organic reducing agent for the substantially light-insensitive organic silver salt are non-sulfo-substituted 6-membered aromatic or heteroaromatic ring compounds with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annelated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substituent is an amino-group.

In preferred reducing agents, the ring atoms of the non-sulfo-substituted 6-membered aromatic or heteroaromatic ring compound consist of nitrogen and carbon ring atoms and the non-sulfo-substituted 6-membered aromatic or heteroaromatic ring compound is annelated with an aromatic or heteroaromatic ring system.

In further preferred reducing agents, the non-sulfo-substituted 6-membered aromatic or heteroaromatic ring compound is substituted with one or more of the following substituents which may also be substituted: alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl.

Particularly preferred reducing agents are substituted catechols or substituted hydroquinones with 3-(3',4'-dihydroxyphenyl)-propionic acid, 3',4'-dihydroxybutyrophenone, methyl gallate, ethyl gallate and 1,5-dihydroxy naphthalene being especially preferred.

During the thermal development process the reducing agent must be present in such a way that it is able to diffuse to the substantially light-insensitive organic silver salt particles so that reduction of the substantially light-insensitive organic silver salt can take place.

Reducing Agent Incorporation

During the thermal development process the reducing agent must be present in such a way that it is able to diffuse to the substantially light-insensitive organic heavy metal salt particles so that reduction of the organic heavy metal salt cam take place.

Molar Ratio of Reducing Agent: Organic Silver Salt

The silver image density depends on the coverage of the above defined reducing agent(s) and organic silver salt(s) and has to be preferably such that, on heating above 80° C., an optical density of at least 1.5 can be obtained. Preferably at least 0.10 moles of reducing agent per mole of organic heavy metal salt is used.

Auxiliary Reducing Agents

The above mentioned reducing agents, regarded as primary or main reducing agents, may be used in conjunction with so-called auxiliary reducing agents. Auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate disclosed in U.S. Pat. Nos. 3,460,946 and 3,547,648.

Spectral Sensitizer

The photo-addressable thermally developable element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable sensitizers of silver halide or infra-red radiation include those disclosed in the EP-A's 465 078, 559 101, 616 014 and 635 756, the JN's 03-080251, 03-163440, 05-019432, 05-072662 and 06-003763 the U.S. Pat. Nos. 4,515,818, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

Water-Dispersible and Water-Soluble Binders

According to the present invention the photo-addressable thermally developable element comprises a binder comprising a water-soluble binder, a water-dispersible binder or a mixture of a water soluble binder and a water-dispersible binder. An important prerequisite in the choice of binders and binder-mixtures is their ability to form a continuous layer with the other ingredients present.

In a preferred embodiment of the present invention the binder is a polymer latex.

In a particularly preferred embodiment the binder is a polymer comprising monomer units selected from the group consisting of a diene-monomer and a methacrylate.

In another particularly preferred embodiment the binder is a polymer comprising monomer units selected from the group consisting of styrene and an acrylate.

An important prerequisite in the choice of binders is their ability to form a continuous layer with the other ingredients present.

The water-dispersible binder can be any water-insoluble polymer e.g. water-insoluble cellulose derivatives, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed under the trade name BUTVAR B79 of Monsanto USA and provides a good adhesion to paper and properly subbed polyester supports. It should be noted that there is no clear cut transition between a polymer dispersion and a polymer solution in the case of very small polymer particles resulting in the smallest particles of the polymer being dissolved and those slightly larger being in dispersion.

Suitable water-soluble polymers, according to the present invention, are: polyvinyl alcohol, polyacrylamide, polyacrylic acid, polymethacrylic acid, polyethyleneglycol, proteins, such as gelatin and modified gelatins such as phthaloyl gelatin, polysaccharides, such as starch, gum arabid and dextran and water-soluble cellulose derivatives.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

Weight Ratio of Binder to Organic Silver Salt

The binder to organic heavy metal salt weight ratio is preferably in the range of 0.2 to 6, and the thickness of the photo-addressable thermally developable element is preferably in the range of 5 to 50 μm.

Thermal Solvents

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

Toning Agent

In order to obtain a neutral black image tone in the higher densities and neutral gray in the lower densities the recording layer contains preferably in admixture with the organic heavy metal salts and reducing agents a so-called toning agent known from thermography or photo-thermography.

Suitable toning agents are succinimide and the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type within the scope of following general formula:

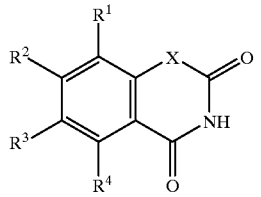

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. Toners within the scope of the general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

Anti-Halation Dyes

In addition to the ingredients, the photothermographic recording material of the present invention may contain anti-halation or acutance dyes which absorb light which has passed through the photosensitive layer, thereby preventing its reflection. Such dyes may be incorporated into the photo-addressable thermally developable element or in any other layer comprising the photothermographic recording material of the present invention. The anti-halation dye may also be bleached either thermally during the thermal development process, as disclosed in the U.S. Pat. Nos. 4,033,948, 4,088,497, 4,153,463, 4,196,002, 4,201,590, 4,271,263, 4,283,487, 4,308,379, 4,316,984, 4,336,323, 4,373,020, 4,548,896, 4,594,312, 4,997,070, 5,258,274, 5,314,795 and 5,312,721, or photo-bleached after removable after the thermal development process, as disclosed in the U.S. Pat. Nos. 3,984,248, 3,988,154, 3,988,156, 4,111,699 and 4,359,524. Furthermore the anti-halation layer may be contained in a layer which can be removed subsequent to the exposure process, as disclosed in U.S. Pat. No. 4,477,562 and EP-A 491 457. Suitable anti-halation dyes for use with infra-red light are described in the EP-A's 377 961 and 652 473, the EP-B's 101 646 and 102 781 and the U.S. Pat. Nos. 4,581,325 and 5,380,635.

Surfactants

Non-ionic, catonic or anionic surfactants may be used, according to the present invention, to produce dispersions of particles of the substantially light-insensitive silver salt of an organic carboxylic acid in aqueous media and to disperse water-dispersible binders, such as polymer latexes, in aqueous media. A mixture of non-ionic and anionic surfactants, of non-ionic and cationic surfactants, of cationic and anionic surfactants or of non-ionic, cationic and anionic surfactants may also be used, according to the present invention.

In one embodiment of the present invention the surfactant is an anionic surfactant. In a preferred embodiment of the present invention the anionic surfactant is a sulfonate e.g. alkyl, aryl, alkaryl or aralkyl sulfonate, with alkyl and alkaryl sulfonates being particularly preferred e.g.:

MERSOLAT™ H, a sodium salt of an alkyl sulfonate from BAYER

ULTRAVON™ W, a sodium salt of an aryl sulfoante from CIBA-GEIGY

In a further embodiment of the present invention the ionic surfactant is a non-ionic surfactant for example alkyl, aryl, alkaryl or aralkyl polyethoxy ethanols. Preferred non-ionic surfactants, according to the present invention, are alkoxy-polyethoxy ethanols and alkaryloxy-polyethoxy ethanols.

Other Additives

In addition to the ingredients the photo-addressable thermally developable element may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Ö1 A (tradename of BAYER AG—GERMANY), ultraviolet light absorbing compounds, white light reflecting and/or ultraviolet radiation reflecting pigments, silica, colloidal silica, fine polymeric particles [e.g. of poly(methylmethacrylate)] and/or optical brightening agents.

Support

The support for the photothermographic recording material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. For example, a paper base substrate is present which may contain white reflecting pigments, optionally also applied in an interlayer between the recording material and the paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

One or more backing layers may be provided to control physical properties such as curl or static.

Protective Layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

This protective layer may have the same composition as an anti-sticking coating or slipping layer which is applied in thermal dye transfer materials at the rear side of the dye donor material or protective layers used in materials for direct thermal recording.

The protective layer preferably comprises a binder, which may be solvent soluble (hydrophobic), solvent dispersible, water soluble (hydrophilic) or water dispersible. Among the hydrophobic binders polycarbonates as described in EP-A 614 769 are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resisn etc., with tetraalkoxysilanes such as tetramethylorthosilicate and tetraethylorthosilicate being preferred.

A protective layer according to the present invention may comprise in addition at least one solid lubricant having a melting point below 105° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder. The surface active agents may be any agents known in the art such as carboxylates, sulfonates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol and fatty acids. Suitable slipping layer compositions are described in e.g. EP 138483, EP 227090, U.S. Pat. Nos. 4,567,113, 4,572,860 and 4,717,711 and in EP-A 311841.

A suitable slipping layer being a layer comprising as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Other suitable protective layer compositions that may be applied as slipping (anti-stick) coating are described e.g. in published European patent applications (EP-A) 0 501 072 and 0 492 411.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Antistatic Layer

In a preferred embodiment the recording material of the present invention an antistatic layer is applied to the outermost layer on the side of the support not coated with the photo-addressable thermally developable element. Suitable antistatic layers therefor are described in EP-A's 444 326, 534 006 and 644 456, U.S. Pat. Nos. 5,364,752 and 5,472,832 and DOS 4125758.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Recording Process

Photothermographic materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 695 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Applications

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications and equivalents as may be included in the spirit and scope of the invention as defined by the appending claims.

The invention is illustrated hereinafter by way of invention examples and comparative examples. The percentages given in these examples are by weight unless otherwise indicated.

INVENTION EXAMPLE 1

In situ Preparation of a Silver Behenate/Silver Halide-Emulsion

Silver behenate was prepared by dissolving 34 g (0.1 moles) of behenic acid in 340 mL of 2-propanol at 65° C., converting the behenic acid to sodium behenate by adding 400 mL of 0.25M aqueous sodium hydroxide to the stirred behenic acid solution and finally adding 250 mL of 0.4M aqueous silver nitrate the silver behenate precipitating out. This was filtered off and then washed with a mixture of 10% by volume of 2-propanol and 90% by volume of deionized water to remove residual sodium nitrate.

After drying at 45° C. for 12 h, the silver behenate was dispersed in deionized water with the anionic dispersion agents Ultravon™ W and Mersolat™ H to produce, after rapid mixing to a predispersion and homogenization with a microfluidizer, a finely divided and stable dispersions containing 20% by weight of silver behenate, 2.1% by weight of Utravon™ W and 0.203% by weight of Mersolat™ H. The pH of the resulting dispersion was adjusted to about 6.5.

The following ingredients were then added with stirring to 1.5 g of the silver behenate dispersion: 1 g of a 30% by weight concentration of a latex-copolymer (obtained by copolymerizing methyl methacrylate, butadiene and itaconic acid in a weight ratio of 45:45:10), 0.01 g of succinimide, 0.1 g of a 11% by weight solution of saponin in a mixture of deionized water and methanol and 2.4 g of a 1.28% by weight aqueous solution of 3-(triphenyl-phosphonium) propionic acid bromide perbromide (PC01), corresponding to a concentration of 8 mol % of PC01 with respect to silver behenate, to accomplish in situ conversion of part of the silver behenate to silver bromide.

Coating and Drying of the Photothermographic Material

A subbed polyethylene terephthalate support having a thickness of 100 μm was doctor blade-coated with the silver behenate/silver bromide dispersion at a blade setting of 60 μm. After drying for several minutes at 40° C. on the coating bed, the emulsion layer was then doctor blade-coated with a 2.44% by weight aqueous solution of 3-(3,4-dihydroxyphenyl)propionic acid at a blade setting of 30 μm. The resulting photothermographic material was first allowed to dry on the coating bed for several minutes at 40° C. and then was dried for 1 hour in a hot air oven at 50° C.

Image-Wise Exposure and Thermal Processing

The photothermographic material was then exposed to ultra-violet light through a test original in contact with the material in an Agfa-Gevaert™ DL 2000 exposure apparatus followed by heating on a heated metal block for 10 s at 95° C. to produce a very good image with a high contrast and good sharpness. The quality of the image obtained was assessed qualitatively and awarded a numerical score between 0 and 5 where these values correspond to:

0=no image

1=a very weak image

2=a weak image

3=a moderate image quality

4=a good image

5=a very good image with high contrast and good sharpness

This material was awarded a score of 5 for image quality.

INVENTION EXAMPLES 2 TO 28

The materials of invention examples 2 to 28 were prepared as described for invention example 1 except that the aqueous solution of the onium polyhalide, 3-(triphenyl-phosphonium)propionic acid bromide perbromide (PC01), was replaced by aqueous solutions of the onium polyhalides given in table 1 and different molar concentrations of these onium polyhalides with respect to silver behenate were used.

From table 1it can be seen that in the case of the phosphonium halide PC03, invention examples 4 to 7, a good image was obtainable at PC03 concentrations of between 8 and 0.5 mol % with respect to silver behenate, indicating a surprising constancy of photosensitivity with decreasing molar concentration of PC03 and hence of the silver iodide formed therefrom. This result enables photothermographic recording materials to be produced with lower silver halide contents and hence enhanced intrinsic stabilities without sacrificing photosensitivity.

TABLE 1

| Invention | Onium polyhalide | | |
|---|---|---|---|
| Example number | Compound(s) used | mol % vs. AgBeh | Image quality assessment |
| 1 | PC01 | 8 | 5 |
| 2 | PC01 | 4 | 5 |
| 3 | PC02 | 8 | 5 |
| 4 | PC03 | 8 | 4 |
| 5 | PC03 | 4 | 4 |
| 6 | PC03 | 1 | 4 |
| 7 | PC03 | 0.5 | 4 |
| 8 | PC02 + PC03 | 3 + 1 | 5 |
| 9 | PC02 + PC03 | 1 + 3 | 5 |
| 10 | PC04 | 4 | 4 |
| 11 | PC05 | 8 | 4 |
| 12 | PC06 | 4 | 5 |
| 13 | PC07 | 8 | 5 |
| 14 | PC08 | 4 | 5 |
| 15 | PC09 | 4 | 4 |
| 16 | PC10 | 8 | 5 |
| 17 | SC01 | 8 | 5 |
| 18 | SC01 | 4 | 4 |

TABLE 1-continued

| Invention | Onium polyhalide | | |
|---|---|---|---|
| Example number | Compound(s) used | mol % vs. AgBeh | Image quality assessment |
| 19 | NC01 | 8 | 5 |
| 20 | NC01 | 4 | 5 |
| 21 | NC02 | 4 | 5 |
| 22 | NC03 | 4 | 3 |
| 23 | NC04 | 4 | 5 |
| 24 | NC05 | 4 | 4 |
| 25 | NC06 | 4 | 3 |
| 26 | NC07 | 8 | 4 |
| 27 | NC08 | 8 | 4 |
| 28 | NC09 | 8 | 3 |

COMPARATIVE EXAMPLES 1 TO 6

The materials of comparative examples 1 to 6 were prepared as described for invention example 1 except that the aqueous solution of the onium polyhalide, 3-(triphenylphosphonium)propionic acid bromide perbromide (PC01) was not added (comparative example 1) or that the aqueous solution of the onium polyhalide, 3-(triphenylphosphonium)propionic acid bromide perbromide (PC01) was replaced by aqueous solutions of the inorganic halides given in table 2 and different molar concentrations of these inorganic halides with respect to silver behenate were used (comparative examples 2 to 5).

Image-wise exposure followed by thermal processing was carried out on the materials of comparative examples 1 to 6 as described for invention example 1 and the image quality assessment values obtained are given in table 2.

TABLE 2

| Comparative | Inorganic halide | | |
|---|---|---|---|
| Example number | Compound(s) used | mol % vs. AgBeh | Image quality assessment |
| 1 | none | 0 | 0 |
| 2 | KBr | 8 | 2 |
| 3 | KBr | 16 | 2 |
| 4 | KI | 8 | 2 |
| 5 | $NH_4Br$ | 8 | 2 |
| 6 | $CaBr_2$ | 8 | 2 |

In the absence of PC01 (comparative example 1) no image was obtained and hence a numerical score of 0 was assigned for image quality. Surprisingly only weak images were obtained when PC01 was replaced by various inorganic halides and numerical scores of 2 were awarded. This is in marked variance with the performance of analogous materials prepared using solvent dispersions of silver behenate emulsions to which inorganic halides had been added, which produced very good images.

COMPARATIVE EXAMPLES 7 AND 8

The materials of comparative examples 7 and 8 were prepared as described for invention example 1 except that the aqueous solution of the onium polyhalide, 3-(triphenylphosphonium)propionic acid bromide perbromide (PC01) was replaced by an ex situ prepared silver halide emulsion of 50 nm particles containing of 96.3 mol % of silver bromide and 3.7 mol % of silver iodide in an aqueous solution of gelatin in a quantity corresponding to 10 mol % and 20 mol % of silver halide with respect to the silver behenate present respectively.

Image-wise exposure followed by thermal processing as described for invention example 1 surprisingly produced only very weak images, which were awarded a numerical score of 1. This is again at variance with the performance of analogous materials prepared by mixing a similar ex situ prepared silver halide emulsion with an aqueous dispersion of silver behenate evaporating off the dispersant, redispersing in an organic solvent, adding appropriate quantities of appropriate reducing and toning agents and then coating and drying the resulting dispersion, with which very good images were obtained under the same exposure and thermal processing conditions.

COMPARATIVE EXAMPLES 9 AND 10

The materials of comparative examples 9 and 10 were prepared using silver behenate/silver halide dispersions produced by producing the silver behenate in the presence of the same silver halide emulsion used in the silver behenate/silver halide dispersions of comparative examples 7 and 8 as described in U.S. Pat. No. 3,839,049. Sodium behenate was first prepared by adding a stoichiometric quantity of sodium hydroxide to an aqueous dispersion of behenic acid, then silver halide emulsion was added in quantities such that 0.1 moles of silver halide (comparative example 9) or 0.2 moles of silver halide (comparative example 10) per mole of sodium behenate and finally the sodium behenate was stoichiometrically converted in the presence of silver halide into silver behenate by adding aqueous silver nitrate as described in invention example 1. The resulting silver behenate/silver halide precipitate was then filtered off and washed with a mixture of 10% by volume of 2-propanol and 90% by volume of deionized water to remove residual sodium nitrate.

After drying at 45° C. for 12 h, the silver behenate/silver halide mixture was dispersed in deionized water with the anionic dispersion agents Ultravon™ W and Mersolat™ H to produce, after rapid mixing to a predispersion and homogenization with a microfluidizer, a finely divided and stable dispersion containing 20% by weight of silver behenate/silver halide mixture, 2.1% by weight of Ultravon™ W and 0.203% by weight of Mersolat™ H. The pH of the resulting dispersion was adjusted to about 6.5.

The following ingredients were then added with stirring to 1.5 g of the silver behenate/silver halide dispersion with 10 mol % silver halide with respect to silver behenate (comparative example 9) or 1.5 g of the silver behenate/silver halide dispersion with 20 mol % silver halide with respect to silver behenate (comparative example 10): 1 g of a 30% by weight concentration of a latex-copolymer (obtained by copolymerizing methyl methacrylate, butadiene and itaconic acid in a weight ratio of 45:45:10), 0.013 g of succinimide and 0.1 g of a 11% by weight solution of saponin in a mixture of deionized water and methanol.

The resulting dispersions were coated and resulting thermographic materials dried as described for invention example 1. Image-wise exposure and thermal processing of these materials was also performed as described for invention example 1 and very weak images were obtained for both the materials of comparative examples 9 and 10, which were awarded a numerical score of 1 for image quality.

This is yet again at variance with the performance of analogous materials prepared by dispersing the dried silver behenate/silver mixtures in an organic solvent, adding appropriate quantities of appropriate reducing and toning agents and then coating and drying the resulting dispersion, with which very good images were obtained under the same exposure and thermal processing conditions.

INVENTION EXAMPLE 29

The material of invention example 29 was prepared as described for invention example 1 except that the silver behenate dispersion was prepared by the process described in the unpublished European patent application number 95201968.5. 60 g of gelatin was dissolved in 1500 g of deionized water in a reaction vessel and the resulting solution heated to 75° C. The UAg, defined as the potential difference between a silver electrode (of ≧99.99% purity) in the liquid and a reference electrode consisting of a Ag/AgCl-electrode in 3M KCl solution at room temperature connected to the liquid via a salt bridge consisting of a 10% $KNO_3$ salt solution, was adjusted to 400 mV. To this solution were simultaneously metered into the reaction vessel a solution of sodium behenate in a mixture of deionized water and 2-propanol at 80° C. and an aqueous solution of silver nitrate at room temperature such that the UAg remained constant at 400 mV. The dissolved salts were then removed by ultrafiltration and the resulting dispersion of silver behenate and after pH adjustment to 6.5 the procedure described in invention example 1 was followed.

Image-wise exposure and thermal processing, as described in invention example 1, produced a very good image with a high contrast, which was awarded a score of 5 for image quality as in the case of the material of invention example 1.

INVENTION EXAMPLE 30

The material of the invention example 30 was prepared as described for invention example 1 except that the binder used was changed, 1 g of a 30% by weight concentration of a latex-copolymer (obtained by copolymerizing methyl methacrylate, butadiene and itaconic acid in a weight ratio of 47.5:47.5:5) being used instead of a 30% by weight concentration of a latex-copolymer (obtained by copolymerizing methyl methacrylate, butadiene and itaconic acid in a weight ratio of 45:45:10). Image-wise exposure and thermal processing of the resulting material, as described in invention example 1, produced a very good image with a high contrast which was awarded a score of 5 for image quality as in the case of the material of invention example 1.

INVENTION EXAMPLE 31

The material of invention example 31 was prepared as described for invention example 1 except that the binder used was changed, 1 g of a 30% by weight concentration of a latex-copolymer (obtained by copolymerizing methyl methacrylate, isoprene and itaconic acid in a weight ratio of 47.5:47.5:5) being used instead of a 30% by weight concentration of a latex-copolymer (obtained by copolymerizing methyl methacrylate, butadiene and itaconic acid in a weight ratio of 45:45:10). Image-wise exposure and thermal processing of the resulting material, as described in invention example 1, produced a very good image with a high contrast which was awarded a score of 5 for image quality as in the case of the material of invention example 1.

INVENTION EXAMPLE 32

The material of invention example 32 was prepared as described for invention example 1 except that the aqueous solution of the onium polyhalide, 3-(triphenyl-phosphonium)propionic acid bromide perbromide (PC01), was replaced by the addition of an aqueous solution of 1-methoxy-2-(triphenyl-phosphonium)ethane tosylate followed by the addition of a solution of potassium bromide. Image-wise exposure and thermal processing of the resulting material, as described in invention example 1, produced a good image which was awarded a score of 4 for image quality.

Having described in detail preferred embodiments of the current invention, it will now be apparent to those skilled in the art that numerous modifications can be made therein without departing from the scope of the invention as defined in the following claims.

What is claimed is:

1. A production method for a photothermographic recording material, said method comprising: (i) providing a support; (ii) coating said support with a photo-addressable thermally developable element comprising a substantially light-insensitive organic silver salt, a photosensitive silver halide in catalytic association with said substantially light-insensitive organic silver salt, a reducing agent in thermal working relationship with said substantially light-insensitive organic silver salt, and a binder, wherein said photosensitive silver halide is formed by reacting an aqueous emulsion of particles of said substantially light-insensitive organic silver salt with at least one onium salt having a halide or polyhalide anion, and said photo-addressable thermally developable element is coated from an aqueous medium.

2. The production method according to claim 1, wherein said onium salt has an organophosphonium, organosulphonium or organo-nitrogen onium cation.

3. The production method according to claim 1, wherein said halide anion is chloride, bromide or iodide.

4. The production method according to claim 1, wherein said polyhalide anion is selected from the group consisting of chlorine atoms, bromine atoms, iodine atoms and any combination thereof.

5. The production method according to claim 1, wherein said onium salt is present in a concentration with respect to said substantially light-insensitive organic silver salt of between 0.1 and 35 mole %.

6. The production method according to claim 1, wherein said substantially light-insensitive organic silver salt is a silver salt of an organic carboxylic acid, and said substantially light insensitive silver salt is produced by a process comprising simultaneous metered addition of a solution or suspension of the organic carboxylic acid or its salt and an aqueous solution of a silver salt to a liquid.

7. The production method according to claim 1, wherein said substantially light-insensitive organic silver salt is a silver salt of a fatty acid.

8. The production method according to claim 1, wherein said binder comprises a water soluble polymer, a water-dispersible polymer or a water soluble polymer and a water-dispersible polymer.

9. A recording process comprising: (i) providing a photothermographic recording material according to claim 1; (ii) bringing said recording material into the proximity of a source of actinic radiation; (iii) image-wise exposing said recording material to said actinic radiation; (iv) bringing said image-wise exposed recording material into proximity with a heat source; (v) thermally developing said image-wise exposed recording material; and (vi) removing said thermally developed image-wise exposed recording material from said heat source.

10. The photothermographic material produced by the production method according to any of claims 1–8.

* * * * *